US005452359A

United States Patent [19]

Inanaga et al.

[11] Patent Number: 5,452,359

[45] Date of Patent: * Sep. 19, 1995

[54] ACOUSTIC SIGNAL REPRODUCING APPARATUS

[75] Inventors: Kiyofumi Inanaga; Hiroyuki Sogawa; Yasuhiro Iida; Susumu Yabe, all of Kanagawa, Japan

[73] Assignee: Sony Corporation, Tokyo, Japan

[ * ] Notice: The portion of the term of this patent subsequent to Jan. 19, 2010 has been disclaimed.

[21] Appl. No.: 752,530

[22] PCT Filed: Jan. 18, 1991

[86] PCT No.: PCT/JP91/00056

§ 371 Date: Mar. 22, 1993

§ 102(e) Date: Mar. 22, 1993

[87] PCT Pub. No.: WO91/11079

PCT Pub. Date: Jul. 25, 1991

[30] Foreign Application Priority Data

Jan. 19, 1990 [JP] Japan ..... 2-8515
Jan. 19, 1990 [JP] Japan ..... 2-8517
Jan. 19, 1990 [JP] Japan ..... 2-8518

[51] Int. Cl.[6] ..... H04R 5/02
[52] U.S. Cl. ..... 381/25; 381/74
[58] Field of Search ..... 381/25, 74, 183, 187

[56] References Cited

U.S. PATENT DOCUMENTS 5,181,248 1/1993 Inananga et al. ..... 381/25

FOREIGN PATENT DOCUMENTS 59-44197 3/1984 Japan ..... 381/25
59-44198 3/1984 Japan ..... 381/25
60-204200 10/1985 Japan ..... 381/74
1-112900 5/1989 Japan ..... 381/74
1-120999 5/1989 Japan ..... 381/74

*Primary Examiner*—Forester W. Isen
*Attorney, Agent, or Firm*—Jay H. Maioli

[57] ABSTRACT

An acoustic signal reproducing apparatus for supplying an acoustic signal to a headphone device, in which position-detecting reference signals from a reference signal source are sensed by a pair of signal sensors provided at two places over a listener's head. The turning angle and the relative distance of the head with respect to the reference signal source are calculated by processing units on the basis of these signal sensors and transmission characteristics with respect to an arbitrarily positioned imaginary sound source are found from the information concerning the relative distance and the turning angle, with the reference signal source as a reference position. Acoustic signals are processed by acoustic signal processing devices on the basis of the transmission characteristics to realize binaural reproduction with respect to the imaginary sound source. A level detection unit detects when the output level of at least one of the signal sensors becomes lower than a reference level and, on the basis of a detection output of the detection unit, the acoustic signals supplied to the headphone device are controlled by a control unit to realize a stable binaural playback operation, and an alarm is supplied to the headphone device in response to the output of the level detection unit.

11 Claims, 6 Drawing Sheets

ACOUSTIC SIGNAL REPRODUCING APPARATUS

TECHNICAL FIELD

This invention relates to an acoustic signal reproducing apparatus for binaural reproduction of acoustic signals.

BACKGROUND ART

For reproducing acoustic signals, with the use of a pair of headphone units which, on being attached to a listener's head, are supported in the vicinity of fastener's auricles, as in the case of a headphone device adapted for reproducing acoustic signals by a headphone unit, there is so far known a binaural system as a method for optimizing a sound image sense or direction feeling or an external stationary sound image feeling.

With an acoustic reproducing system of the binaural system, acoustic signal reproduced by the headphone device are previously processed in a predetermined manner, as described for example in Japanese Patent Kokoku Publication No. 53-283 (1978).

The sound image sense feeling or the external fixed sound image feeling its determined by sound volume difference, timing difference or phase difference between the sound heard by the left ear and that heard by the right ear.

The above mentioned signal processing is such a signal processing in which, when the acoustic sound is to be reproduced by speaker devices arranged at a distance from the listener, the acoustic effect equivalent to those produced by reflection or diffraction in the vicinity of the listener's head or the difference in the distance between the sound source or the speaker devices and the listener's left and right ears will be produced in an acoustic output reproduced by the headphone devices. Such signal processing is performed by convolutional integration of an impulse response corresponding to the acoustic effects or acoustic signals for left and right ears.

It is noted that, when the acoustic sound is to be reproduced by the speaker devices arranged at a distance from the listener, since the absolute position of the sound image remains unchanged even if a listener should make bodily movements or turn his head, the relative sense and position of a sound image felt by the listener are changed. On the contrary, when the acoustic sound is to be reproduced by the binaural system using the headphone device, since the headphone device is rotated with the listeners head when the listener turns his head, the relative sense and position of the sound image felt by the listener are not changed.

In this manner, in case of binaural reproduction by the headphone device, since a sound field is produced within the listener's head by the difference in the shifting state of sound image relative to changes in the sense of the listener's head, it becomes difficult to fix a sound image ahead of the listener. Besides, the forward sound image tends to be raised in its position.

Heretofore, as described in Japanese Patent, KOKAI Publication No. 42-227 or Japanese Patent Kokoku Publication No. 54-19242, there is proposed an acoustic signal reproducing system in which, by detecting changes in the sense of the listener's head, and changing the state of the signal processing based on the detected results, a satisfactory forward fixed sound image feeling may be obtained in the headphone device with this type of the acoustic signal reproducing system, a sense detection unit, such as a so-called gyrocompass or a magnetic needle, is attached to the listener's head. On the basis of the detected results by said sense detection unit, a delay circuit or the aforementioned level adjustment circuit, processing acoustic signals is controlled to produce a sound field feeling similar to that produced in acoustic reproduction by speaker devices arranged at, a distance from the listener.

Meanwhile, with a conventional binaural reproducing system in which the sense detecting unit such as the gyrocompass is provided in the headphone device, by controlling the contents of the signal processing of the acoustic signals as a function of changes in the sense of the listener's head, a satisfactory fixed sound image feeling may be acquired, as a principle, insofar as the listener remains at a predetermined position.

However, since the sense detecting device for detecting changes in the sense of the listener's head becomes large in size and weight, the construction necessarily needs to be of a stationary type with the fixed listening position.

That is, the sense detection device, such as a gyrocompass, is too large in size and weight to be attached to the listener's freely mobile head, and is not practically usable with a portable type headphone device.

On the other hand, if the listener should make bodily movements, the sound image is also shifted, so that there results an unspontaneous fixed sound image feeling.

When the listener approaches a sound source, such as a speaker device, the round pressure level is usually increased. On the other hand, since the sound source, such as a speaker device, has directivity, the effects of directivity are demonstrated by the listener's bodily movements. This gives rise to an outside fixed sound image feeling.

It is therefore an object of the present invention to provide an acoustic signal reproducing apparatus in which, in view of the above described status of the art, an extremely natural fixed round image feeling without the imaginary sound source position being moved with the headphone device despite the listener's occasional bodily movements may be realized to enable satisfactory binaural reproduction.

It is another object of the present invention to provide an acoustic signal reproducing apparatus in which stable binaural reproduction may be achieved with the headphone device attached to the listener's freely mobile head.

It is a further object of the present invention to provide a headphone device having a head turning angle detecting function whereby changes in the sense of the listener's may be detected quickly, accurately and stably.

DISCLOSURE OF THE INVENTION

The present invention provides an acoustic signal reproducing apparatus comprising a reference signal source for sending out a position-detecting reference signal for sensing the position of the listener's head, a pair of signal sensor means provided at two positions above the listener's head and adapted for receiving the reference signal from said reference signal source, processing means for calculating the relative distance and the turning angle of the head relative to detection output signals from said signal sensor means for finding transmission characteristics for an imaginary sound source which is optionally positioned with said reference signal source as a reference position, and acoustic signal processing means for processing left-channel acoustic input signals and right-channel acoustic input signals on the basis of an information representing said transmission characteristics as found by said processing means, wherein acoustic signals through said acoustic signal processing means are reproduced by a headphone device. Thus, with the acoustic signal reproducing apparatus of the present invention, the position-detecting reference signal, sent out from the reference signal source, is received by a pair of signal sensor means provided at, two places over the listener's head, the relative distance and the turning angle of the listener's head with respect to said reference signal source are calculated by processing means on the basis of output signals from the signal sensor means, the transmission characteristics with respect to an arbitrarily positioned imaginary sound source are found from the information concerning the relative distance and the turning angle, with the reference signal source as the reference position, and the acoustic signals are processed on the basis of these transmission characteristics to realize satisfactory binaural reproduction with respect to the imaginary sound source. The acoustic signal reproducing apparatus also comprises level detection means for detecting that the detection level of at east one of the signal sensor means has become lower than a reference level, and control means for controlling the acoustic signal to be supplied to the headphone device on the basis of a detection output of the level detection means. Thus, with the acoustic signal reproducing apparatus according to the present invention, the level detection means detects that the detection level of at least one of the signal sensor means has become lower than the reference level and the acoustic signals supplied to the headphone device is controlled by control means on the basis of the detection output to realize stable binaural reproduction.

The present invention also provides a headphone device comprising a pair of headphone units supplied with acoustic signals from an acoustic signal source, said headphone device further comprising a main head body comprising said pair of headphone units and a connecting part interconnecting said headphone units, at least two signal sensor means for receiving signals for detecting the head turning angle information transmitted from a reference signal source, and supporting means for supporting said signal sensor means so that, when said main headphone body is attached to the listener's head, said signal sensor means are disposed on left and right sides of the center of said main headphone member, and so that said signal sensor means are disposed at positions spaced from said main headphone member, said signal sensor means being attached to said main headphone body by means of said supporting means. Thus, with the headphone device according to the present invention, the signal sensor means always receive signals detecting the information concerning the turning angle of the listener's head in good conditions for stably detecting the information concerning the turning angle of the listener's head.

BEST EMBODIMENT FOR PRACTICING THE INVENTION

Figure 1:
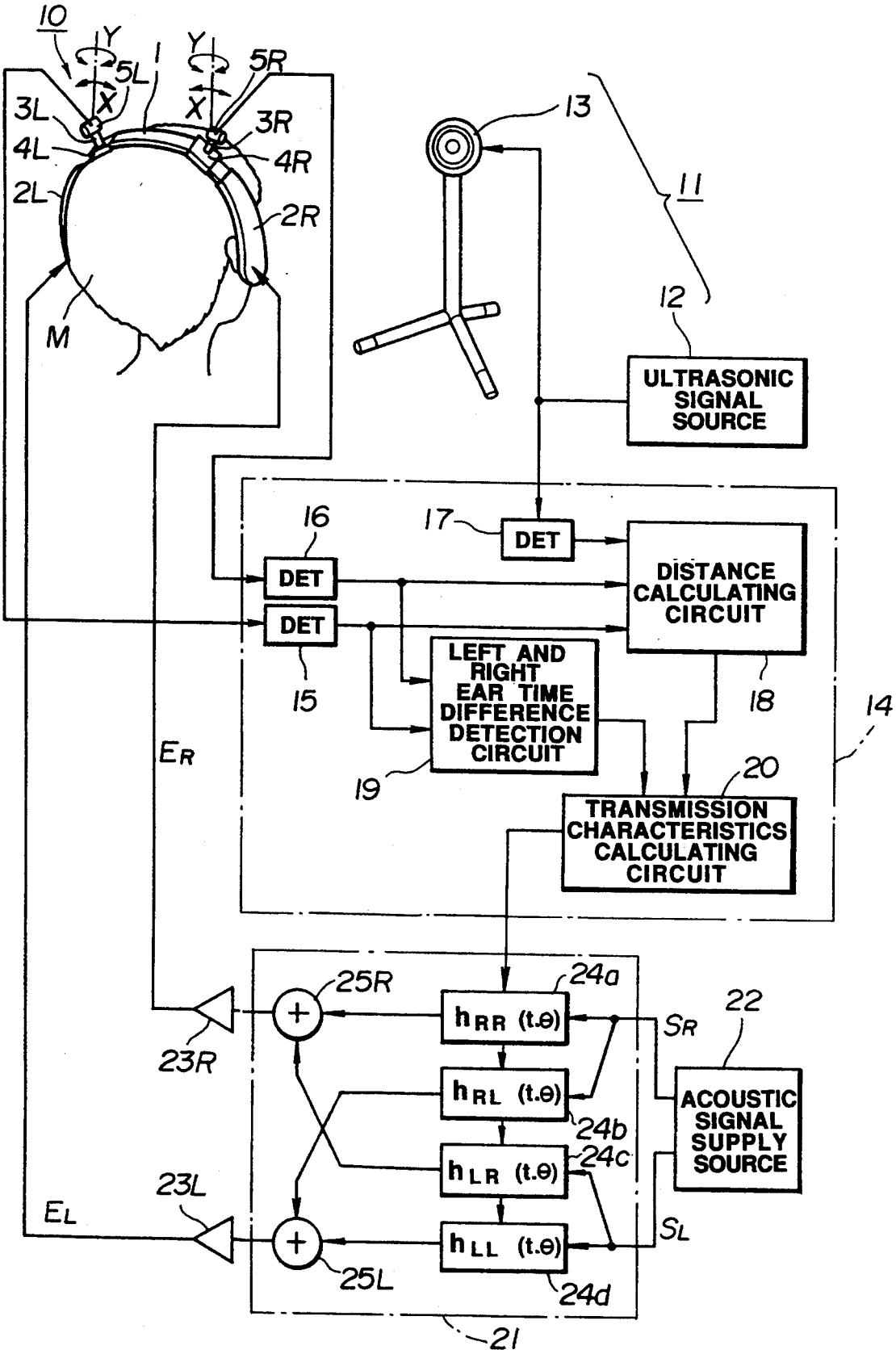
FIG. 1 is a block diagram showing schematically the construction of an acoustic signal reproducing apparatus according to the present invention.

An acoustic signal reproducing apparatus according to a first embodiment of the present invention, shown in FIG. 1 , includes a headphone device 10, attached to a user's head M by a head band 1 and adapted for supporting a pair of headphone units 2L, 2R in the vicinity of user's left and right auricles, respectively.

Sliders 4L, 4R, provided with supporting arms 3L, 3R, respectively, are slidably attached to the head band 1 of the headphone device 10. A pair of signal sensors 5L, 5R for sensing position detecting reference signals sent out from a reference signal source 11 are provided on the distal ends of the supporting arms 3L, 3R, respectively. That is, the signal sensors 5L, 5R, thus provided at the distal ends of the supporting arms 3L, 3R mounted upright on the sliders 4L, 4R slidably mounted on the head band 1, are supported by the supporting arms 3L, 3R at a position removed from a main headphone body constituted by the head band 1 and the headphone units 2L, 2R.

In the present embodiment, the reference signal source 11 is constituted by an ultrasonic signal source 12 and an ultrasonic speaker 13 sending out ultrasonic signals from the ultrasonic signal source 12 as reference signals. Ultrasonic microphones are employed as the signal sensors 5L, 5R adapted for sensing the reference signals.

Figures 2A, 2B, 2C, 2D, 2E, 2F:
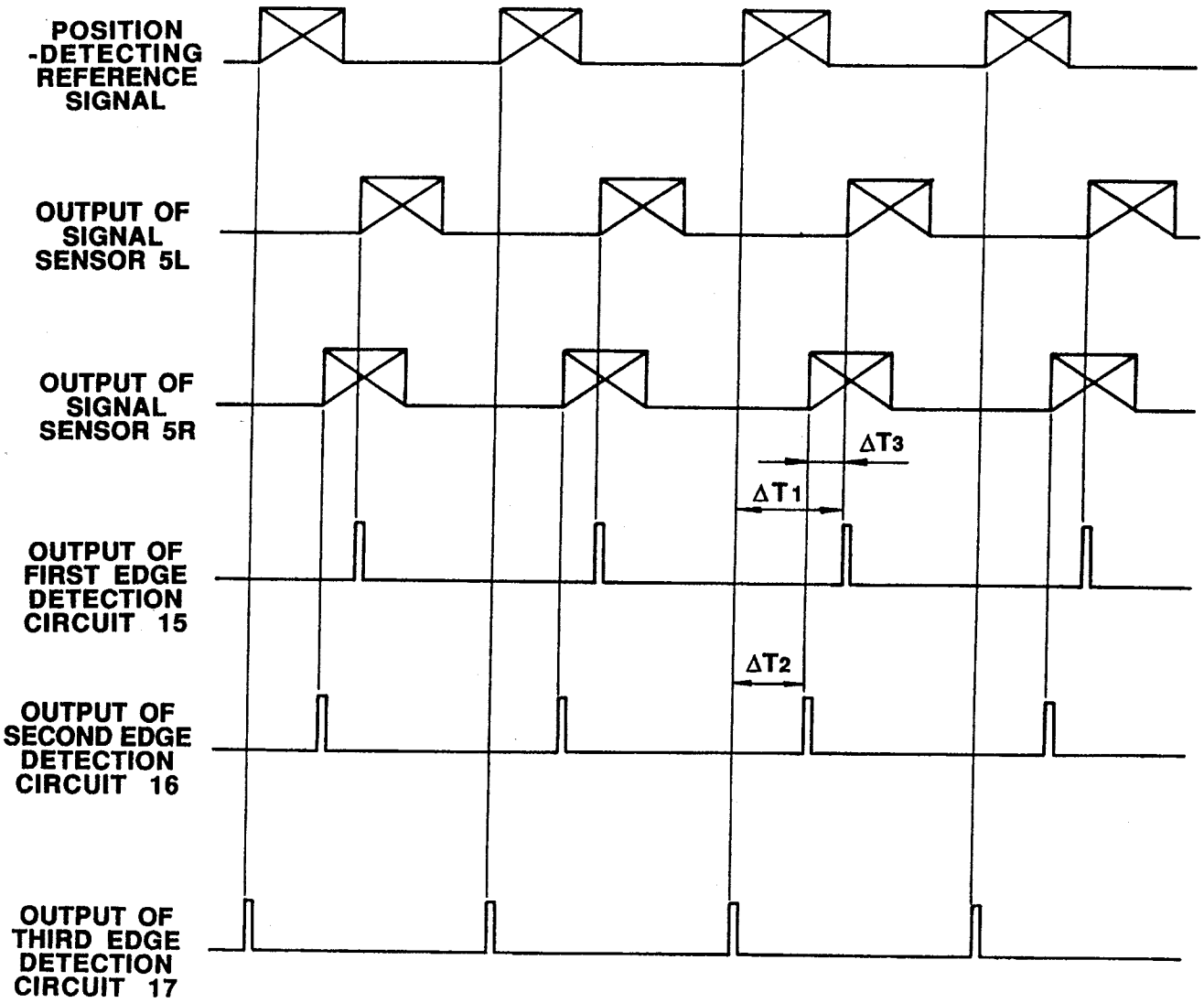
FIGS. 2(A) to 2(F) are a timing chart schematically showing the state of signals supplied to a processing device of the acoustic signal reproducing apparatus.

The ultrasonic waves transmitted from the ultrasonic speaker 13, that is the position-detecting reference signals, are ultrasonic waves adapted to enable phase detection, such as burst waves in which ultrasonic waves of a predetermined level are intermittently transmitted at a predetermined time interval, as shown in FIG. 2A, or a so-called level modulated wave, in which the signal level is fluctuated in a predetermined manner at a predetermined time period.

The signal sensors 5L, 5R, provided at the headphone device 10, sense the position-detecting ultrasonic reference signals, transmitted from the ultrasonic speaker 13, to output detection signals having time delay corresponding to the relative position between the listener and the ultrasonic speaker 13, as shown in FIGS. 3B and 3C.

The signal sensors 5L, 5R are provided at the distal ends of the supporting arms 3L, 3R mounted upright on the sliders 4L, 4R slidably mounted on the lead band 1 and, with the head band 1 and the headphone units 2L, 2R, that is the main headphone body, being attached to the user's head, are supported by the supporting arms 3L, 3R at positions removed from the main headphone body, so that, even when the user moves his body or turns his head, the signal sensors are not in the shade of the user's head, and are able to receive ultrasonic waves transmitted from the ultrasonic speaker 13 satisfactorily to sense the position-detecting reference signals stably and accurately. On the other hand, the signal sensors 5L, 5R may be adjusted to optimum positions for sensing the position-detecting reference signals by sliding the sliders 4L, 4R along the head band 1. Since the position of the headphone units 2L, 2R, attached by the head band 1 to the listener's head M so as to be supported in the vicinity of the listener's left and right auricles, depends on the size and the shape of the user's head and differs from user to suet. Therefore, the position of the signal sensors 5L, 5R needs to be adjusted so as to be in meeting with the positions of the headphone units 2L, 2R.

Meanwhile, although the signal sensors 5L, 5R are provided at the distal ends of the supporting arms 3L, 3R mounted upright on the sliders 4L, 4R slidably mounted on the head band 1 of the main headphone body, the signal sensors 5L, 5R may also be mounted on a housing of the headphone units 2L, 2R by means of supporting members so as to be supported at some distance from the main headphone body mounted on the listener's head. Instead of adjusting the position of the signal sensors 5L, 5R by sliding the sliders 4L, 4R, the supporting arms 3L, 3R may be pivotally supported at the proximal ends thereof so as to be pivoted in a direction shown by an arrow X in FIG. 1 for adjusting, the supporting arm positions, or alternatively, the signal sensors 5L, 5R per se or the supporting arms 3L, 3R may be supported such as by bearing means, so as to be pivoted in a direction shown by an arrow Y in FIG. 1, for adjusting the orientation of the signal sensors 5L, 5R in association with directivity of the ultrasonic speaker 13.

The sensed signals from the signal sensors are transmitted to a processing unit 14.

The processing unit 14 includes first and second edge detection circuits 15, 16, supplied with the sensed position-detecting reference signals from the signal sensors 5L, 5R, and a third edge detection circuit 17 supplied with ultrasonic signals from the ultrasonic signal source 12, that is the position-detecting reference signals.

The first and second edge detection circuits 15, 16 detect the falling edges of the sensed signals from the signal sensors 5L, 5R to output pulse signals in register with these rising edges as shown in FIGS. 2D and 2E. The pulse signals from the first and second edge detection circuits 15, 16 are supplied to a distance calculating circuit 18 and left and right ear time difference detection circuit 19. The third edge detection circuit 17 detects a rising edge of the ultrasonic signal from the ultrasonic signal generator 12 to output a pulse signal in register with the rising edge, as shown in FIG. 2F. The pulse signal produced by the third edge detecting circuit 17 is supplied to the distance calculating circuit 18.

The distance calculating circuit 18 detects a time difference $t_1$ between a pulse signal produced by the third edge detection circuit 17 and a pulse signal producing by the first edge detection circuit 15, shown by $\Delta T_1$ in FIG. 2, and a time difference $t_2$ between a pulse signal produced by the third edge detection circuit 17 and a pulse signal produced by the second edge detection circuit 16, shown by $\Delta T_2$ in FIG. 2. The circuit 18 then calculates, on the basis of the time difference $t_1$ and $t_2$ and the sound velocity V, the distance $l_0$ between the ultrasonic speaker 13 and the center of the listener's head M, as shown by an arrow $l_0$ is FIG. 3.

Meanwhile, the sound velocity V may be set previously as a constant, or may be adapted to be changed as a function of fluctuations in atmospheric temperature or pressure, or humidity. In calculating the distance $l_1$ corrections may be made on the basis of the relative disposition between the signal sensors 5L, 5R and the center of the listener's head M and/or the size or shape of the listener's head M.

The signals for the distance $l_0$ and the time differences $t_1$ and $t_2$ are supplied to a transmission characteristics calculating circuit 20.

The left and right ear time difference detection circuit 19 detects a time difference $t_3$ between the pulse signal of the first edge detection circuit 15 and the pulse signal of the second edge detection circuit 15, as shown by $\Delta T_3$ in FIG. 2. A signal for the time difference $t_3$ is transmitted to the transmission characteristics calculating circuit 20.

Figure 3:
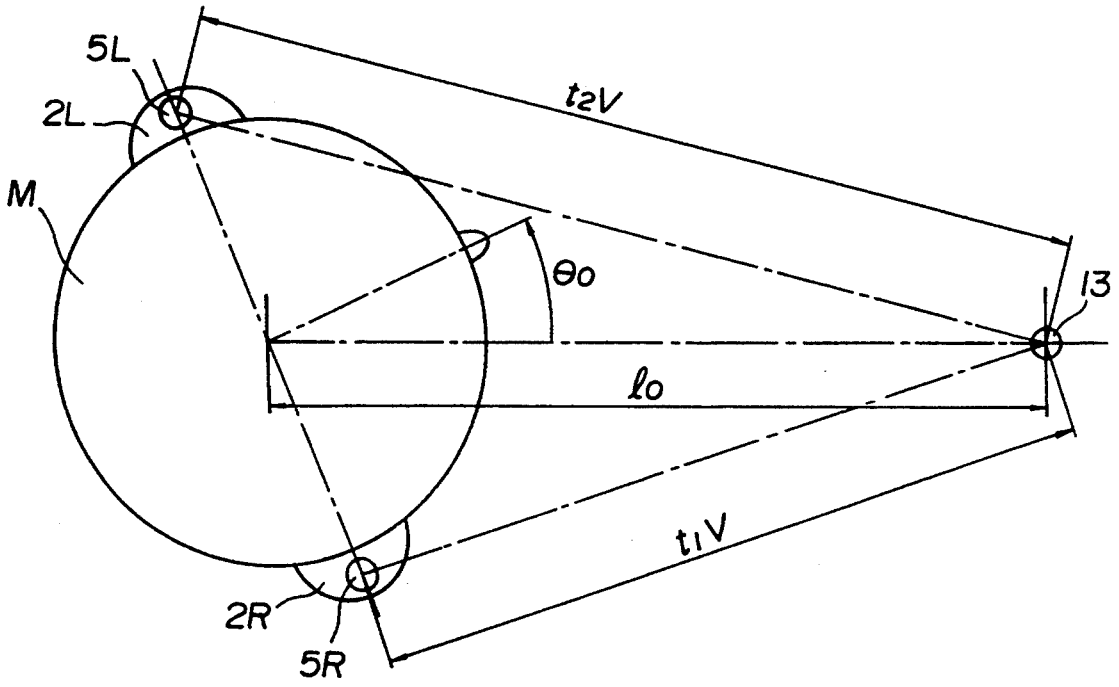
FIG. 3 is a diagrammatic view showing the distance and the angle calculated by the processing device of the acoustic signal reproducing apparatus.

The transmission characteristics calculating circuit 20 calculates, using the time differences $t_1$, $t_2$ and $t_3$, distance $l_0$, sound velocity V and a radius r of the head M, an angle $\theta_0$, which stands for orientation of the head M, as shown by an arrow $\theta_0$ in FIG. 3. The angle $\theta_0$ may be found from, for example, $$\theta_0 \doteq \sin^{-1}\{V^2(t_1 \div t_2)t_3/4\ r\} \quad (1)$$

The calculating circuit 20 calculates, from the information concerning the angle $\theta_0$ and the distance $l_0$, indicating the relative disposition between the position of the ultrasonic speaker 13 as a reference position of an imaginary sound source and the listener's head M, a rotational angle $\theta$ of the head M relative to the desired imaginary sound source position and a relative distance l of the head M from the imaginary sound source, to find transmission characteristics in which directivity or the like of the desired imaginary sound source is taken into consideration.

The transmission characteristics information, which is obtained by the calculating circuit 20 and in which directivity or the like of the imaginary sound source in taken into consideration is supplied to an acoustic signal processing circuit 21.

To the headphone units 2L and 2R, left and right channel acoustic signals $S_L$ and $S_R$, outputted from the acoustic signal supply source 22, are supplied from the acoustic signal 21 by means of a pair of amplifiers 23L, 23R, respectively.

The above mentioned acoustic signal supply source 22 may be any of a variety of recorded disc reproducing apparatus, recorded tape reproducing apparatus or an electrical wave receiver, for example, adapted for outputting left and right channel acoustic signals $S_L$ and $S_R$ acoustic signals $S_L$ and $S_R$, respectively.

The acoustic signal processing circuit 21 is adapted for processing the left and right channel acoustic signals $S_L$ and $S_R$ transmitted from the acoustic signal supply source 22, and is provided with first to fourth signal processing sections **24*a*, 24*b*, 24*c* and 24*d*, supplied with a transmission characteristics information which takes the directivity or the like of the imaginary sound source, obtained by the transmission characteristics calculating circuit 20**, into account. In each of these signal processing sections, an impulse response is set, which is an expression of transmission characteristics to the listener's right and left ears when the left and right channel acoustic signals $S_L$, $S_R$ are to be reproduced, on the basis of the above mentioned transmission characteristics information, with the left and right channel speaker, apparatus disposed ahead of the listener at a distance from each other, as the imaginary sound source.

That is, in the signal processing section 24a, an impulse response $\{h_{RR}(t, \theta)\}$ is set, which is an expression of transmission characteristics to the listener's right ear of an acoustic sound reproduced from the right channel acoustic signal $S_R$. In the second signal processing section 24b, an impulse response $\{h_{RL}(t, \theta)\}$ is set, which is an expression of transmission characteristics to the left ear of an acoustic sound reproduced from the right channel acoustic signal $S_R$. In the third signal processing section 24c, an impulse response $\{h_{LR}(t, \theta)\}$ is set, which is an expression of transmission characteristics to the right ear of an acoustic sound reproduced from the left channel acoustic signal $S_L$. Finally, in the fourth signal processing section 24d, an impulse response is set, which is an expression of transmission characteristics to the left ear of an acoustic sound reproduced from the left channel acoustic signals $S_L$.

Meanwhile, these impulse responses may be preset in accordance with transmission characteristics, which take the directivity or the like of the imaginary sound source into consideration, and may then be stored in a memory, such as a ROM, so as to be read out in accordance with a readout address determined by the distance l and the angle $\nu$.

In the acoustic signal processing circuit 21 , the right channel acoustic signal $S_R$ is transmitted to the first and second signal processing sections 24a, 24b. In the first signal processing section 24a, the right channel acoustic signal $S_R$ is processed by convolutional integration of the impulse response $\{h_{RR}(t, \theta)\}$. On the other hand, in the second signal processing section 24b, the right channel acoustic signal $S_R$ is processed by convolutional integration of the impulse response $\{h_{RL}(t, \theta)\}$.

The left channel acoustic signal $S_L$ is transmitted to the third and fourth signal processing sections 24c, 24d. In the third signal processing section 24c, the left channel acoustic signal $S_L$ is processed by convolutional integration of the impulse response $\{h_{LR}(t, \theta)\}$. On the other hand, in the second signal processing section 24d, the left channel acoustic signal $S_L$ is processed by convolutional integration of the impulse response $S_L$.

The output signal of the first signal processing section 24a and the third signal processing section 24c are summed together by a right channel adder 25R. The output of the right channel adder 25R is transmitted via right channel amplifier 23R to the right channel headphone unit 2R of the headphone apparatus so as to be reproduced as right channel acoustic signals $E_R$.

The output signals of the second signal processing section 24b and the fourth signal processing section 24d are summed together by a left channel adder 25L, The output signal of the left channel adder 25L is transmitted via left channel amplifier 23L to the left channel headphone unit 2L of the headphone apparatus 10 so as to be reproduced as left channel acoustic signal $E_L$.

With the above described acoustic signal reproducing apparatus of the present invention, the position of a rotational angle $\theta$ of the head M relative to the desired imaginary sound source position and the relative distance l of the head from the Imaginary sound source are calculated from the Information concerning the above mentioned angle $\theta_0$ and the distance $l_0$ indicating the relative disposition between the listener's head M and the position of the ultrasonic speaker 13 as the reference position of the imaginary sound source to find the transmission characteristics which take the directivity of the like of the desired imaginary sound source into consideration and, on the basis of the information concerning the transmission characteristics, the left and right channel acoustic signals $S_L$ and $S_R$ are processed on the real time basis. Thus, with the present acoustic signal processing apparatus, by signal processing designed to cope with changes in transmission characteristics brought about by the listener's bodily movement and turning of the head M, a stationary external sound source position feeling and a stationary forward sound source feeling similar to those when the acoustic signals are reproduced by a pair of speaker devices SL and SR disposed on the front side of and in opposition to the user at a distance from each other, as shown for example in FIGS. 4A, 4B and 4C showing the relative disposition between the imaginary sound source and the listener, may be produced.

Figure 4A:
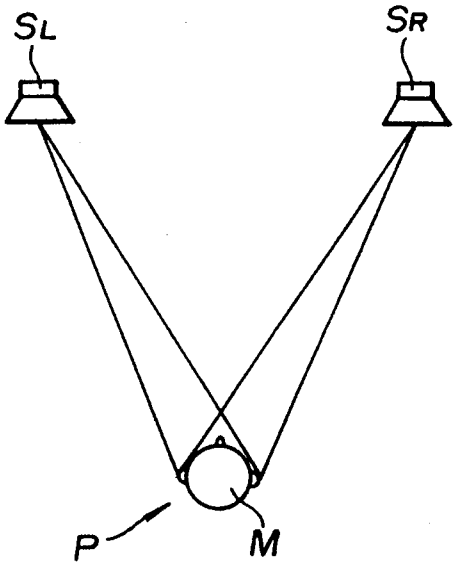
FIGS. 4(A)–4(C) are a plan view showing the relative disposition between an imaginary sound source and the listener for illustrating the operation of binaural reproduction by the acoustic signal reproducing apparatus.
Figure 4B:
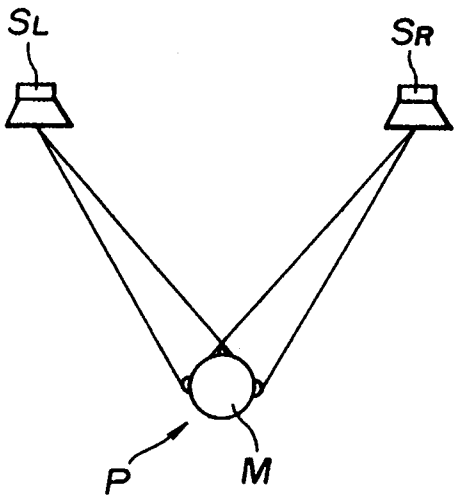
Figure 4C:
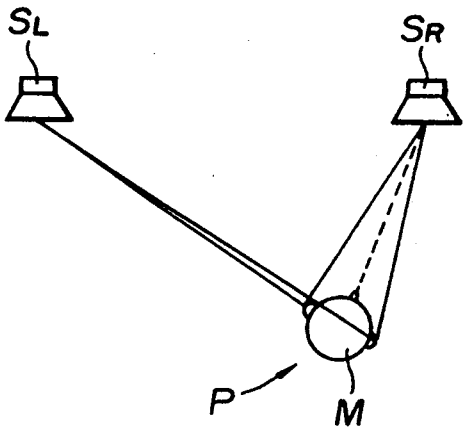

FIG. 4B shows the state in which a listener P has approached the imaginary sound source from the state in which he is disposed with respect to the speaker devices $S_L$, SR, that is the imaginary sound source as shown in FIG. 4A, and FIG. 4C shows the state in which the listener P has turned his head M towards the right speaker device SR. With the acoustic signal reproducing apparatus of the present invention, by signal processing designed to cope with changes in transmission characteristics caused by the listener's bodily movement and head rotation on the real time basis, as described hereinabove, a good stationary external sound source position feeling and a good forward stationary sound source feeling may be had, in which the imaginary sound source is not moved, so that binaural reproduction which may cope with any of the states shown in FIGS. 4A, 4B OF 4C may be achieved.

The headphone apparatus according to the present invention is not limited to the above described type which is provided with a pair of headphone units 2L, 2R supported by the head band 1 but may also be of the type which is provided with a main headphone body similar in shape to a helmet worn by racers or pilots.

Figure 5:
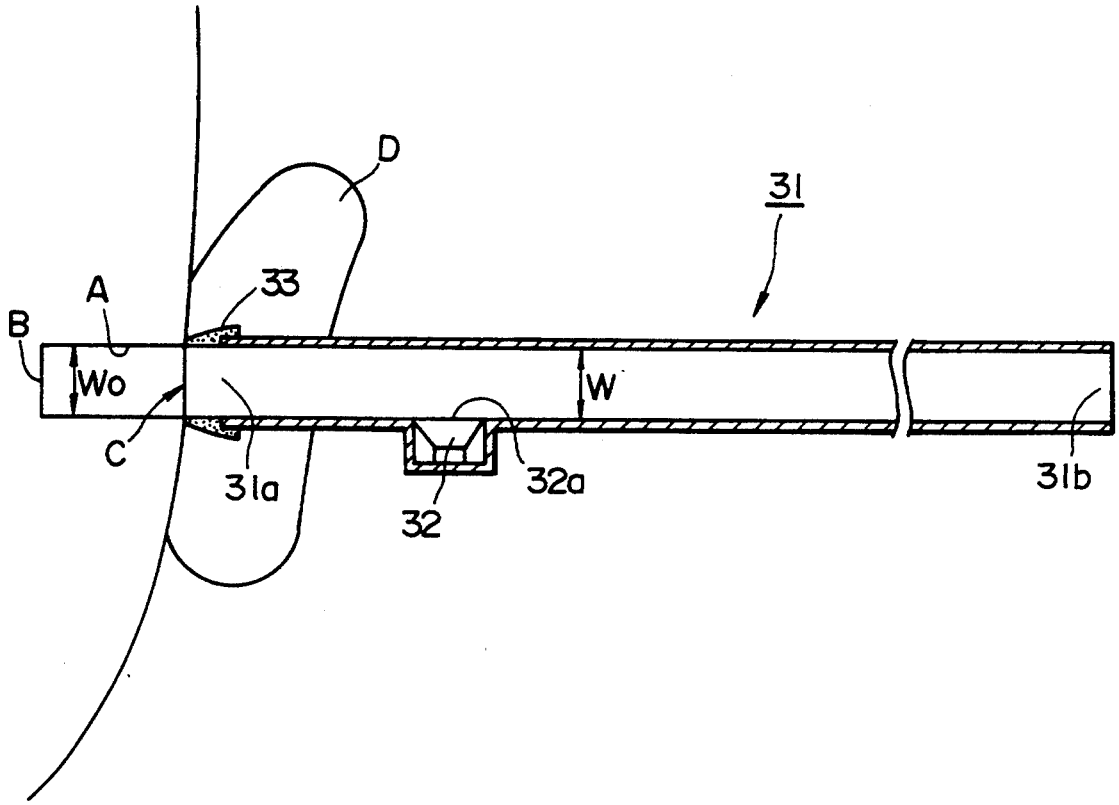
FIG. 5 is a cross-sectional view for one channel showing the basis construction of the headphone device employed in the acoustic signal reproducing apparatus.

The basic construction of the above described headphone apparatus 10, employed in the acoustic signal reproducing apparatus of the present embodiment, includes an acoustic tube 31, constituted by a headphone unit casing, and a speaker unit 32 provided on the inner peripheral surface of the acoustic tube 31, as shown in FIG. 5, in which components for one channel of the headphone unit 2L or 2R illustrated.

The acoustic tube 31 has an inner diameter W approximately equal to the inner diameter of an external auditory miatus A. The acoustic tube 31 is an elongated tubular member having a uniform inner diameter W and has its one opening end 31 fitted with an auricle attachment part and its other opening end formed as a non-reflective terminal.

The auricle attachment section 33 is formed of elastic synthetic resin and has a reduced thickness towards to distal end. The auricle attachment section 33 is attached in position with the distal end introduced into an inlet C of the external auditory miatus A.

Meanwhile, the auricle attachment section 33 has an inner diameter $W_1$ approximately equal to the inner diameter W of the acoustic tube 31, that is, the inner diameter $W_0$ of the external auditory miatus A.

The above mentioned speaker unit 32 is attached to the acoustic tube 31 so that its sound radiating surface 32*a* is flush with the inner peripheral surface of the acoustic tube 31 and faces the interior of the tube 31.

In this manner, the speaker unit 32 is attached to the acoustic tube 31 with the sound radiating surface 32*a* substantially flush with the inner periphery of the acoustic tube 31 so as not to disturb acoustic characteristics of the acoustic tube 31.

When the acoustic tube 31 is attached with the distal end of the auricle attachment section 33 introduced into the inlet C of the external auditory miatus A, a continuous sound duct with a constant acoustic impedance is formed from the tympanic membrane B within the external auditory miatus A as for as the non-reflective opening end 31*b* of the acoustic tube 31.

Thus a voice output from the speaker unit 32 is not reflected while it is propagated via acoustic tube 31 towards the external auditory miatus A, whereas the sound reflected by the tympanic membrane B is not reflected while it is propagated from the external auditory miatus A towards the acoustic tube 31.

Moreover, since the opening end 31*b* is designed as a non-reflective terminal end for acoustic sound, the voice output propagated to the acoustic tube 31 from the speaker unit 32 or the reflected sound from the external auditory miatus A is not reflected at the opening end 31*b*. Since the reflected sound from the tympanic membrane B is not reflected at the speaker unit 32 so as to be repropagated towards the external auditory miatus A, a forward stationary external sound source feeling by binaural reproduction may be achieved.

With the above described headphone apparatus 10 of the present invention, a pair of signal sensor means, each supported by supporting means at a position spaced from the main headphone body attached to the listener's head, are adapted for sensing a signal indicating the turning angle of the listener's head relative to the sound source, so that the information concerning the turning angle of the listener's head may be detected promptly, accurately and stably by the signal sensor means. The output of the signal sensor means may be used as the information concerning the turning angle of the listener's head which is required for binaural reproduction of acoustic signals.

Thus the present invention provides a headphone apparatus which may be attached to a listener's mobile head to achieve a stable binaural reproduction.

The acoustic signal reproducing apparatus of the present invention calculates, by processing means, the transmission characteristics with respect to an arbitrary imaginary sound source, from the distance and the turning angle of the listener's head with respect to the reference position of the imaginary sound source as the reference signal source, on the basis of the output signal of a pair of signal sensors sensing the position-detecting reference signal transmitted from the reference signal source. The left and right channel acoustic signals are processed by acoustic signal processing means, on the basis of the transmission characteristics calculated by the processing means, and the thus processed acoustic signals are supplied to the headphone apparatus, so that binaural reproduction may be performed in such a manner that a highly spontaneous stationary sound image position feeling may be obtained, in which the imaginary sound source position is not moved even if the listener should shift his position.

By referring to FIG. 6, a second embodiment of the acoustic signal reproducing apparatus of the present invention will be explained.

Figure 6:
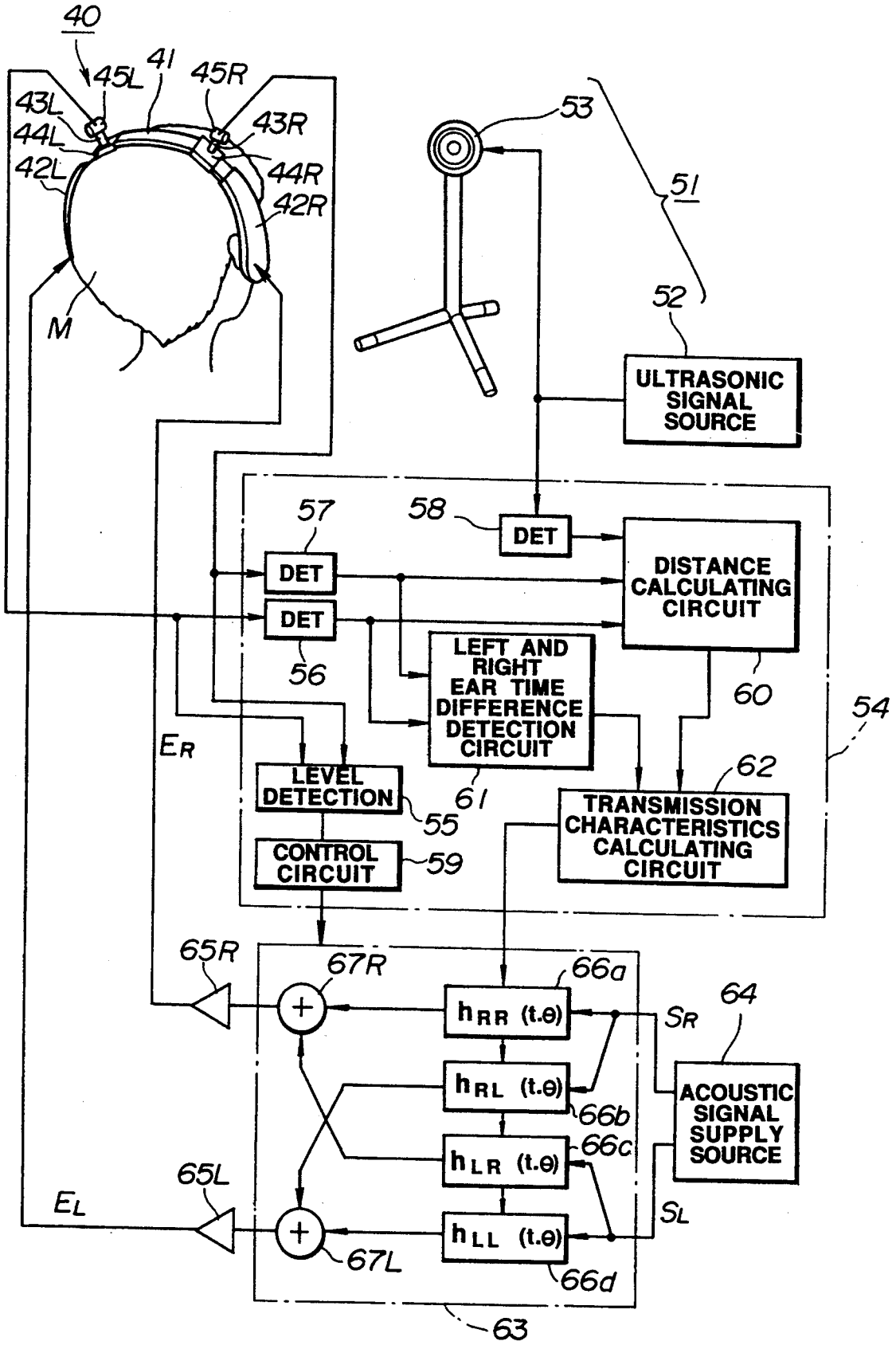
FIG. 6 is a block diagram showing schematically a modified construction of an acoustic signal reproducing apparatus according to the present invention.

Similarly to the above described first embodiment, acoustic signal reproducing apparatus shown in FIG. 6 is provided with a headphone apparatus 40 which is attached to a listener's head M by a head band 41 and which is adapted for supporting a pair of headphone units 42L, 42R in the vicinity of the listener's left and right auricles.

Sliders 44L, 44R on which supporting arms 43L, 43R are mounted upstandingly, are slidably mounted on the head band 41, and a pair of signal sensors 45L, 45R, adapted for sensing position-detecting reference signals, transmitted from a reference signal source 51, are provided at the distal ends of the supporting arms 43L, 43R. The signal sensors 45L, 45R, provided a the distal ends of the supporting arms 43L, 43R protuberantly formed on sliders 44L, 44R slidably mounted on the head band 41 , are supported in this manner at the positions spaced from the head band 41 and the headphone units 42L, 42R, that is the main headphone body.

The reference signal source 51 is constituted by an ultrasonic signal source 52 and an ultrasonic 53 adapted for transmitting ultrasonic signals from the ultrasonic signal source 42 as reference signals. Ultrasonic microphones are used as the signal sensors 45L, 45R sensing the reference signals.

The ultrasonic waves transmitted from the ultrasonic speaker 13, that is the position-detecting reference signals, are ultrasonic waves adapted to enable phase detection, such as burst waves, in which ultrasonic waves of a predetermined level are intermittently transmitted at a predetermined time interval, as in the above described fi rat embodiment, or a so-called level modulated wave, in which the signal level is fluctuated in a predetermined manner at a predetermined period.

The signal sensors 45L, 45R, provided at the headphone device 10, sense the position-detecting ultrasonic reference signals, transmitted from the ultrasonic speaker 53, to output detection signals having time delay corresponding to the relative position between the listener and the ultrasonic speaker 53.

The output signals from the signal sensors 45L, 45R are supplied to a processing device 54.

The processing device 54 includes a level detection circuit 15, supplied with output signals from the signal sensors 45L, 45R sensing the position-detecting reference signals, first and second edge detection circuits 56, 57, and a third edge detection circuit 58, supplied with ultrasonic signals from the ultrasonic signal source 52, that is the above mentioned position-detecting reference signals.

The level detection circuit 55 compares the signal level of the output signal from each of the signal sensors 45L, 45R to a reference level, and outputs to a control circuit 59 an output signal which goes high, for example, when the signal level of at least one of the output signals falls below the reference level. The control circuit 49 is responsive to the output signal from the level detection circuit 55, which indicates by a logical high ("H") state that the signal level of at least one of the output signals has become lower than the reference signal, so as to supply a hold control signal to an acoustic signal processing circuit 63, which will be explained subsequently.

On the other hand, the first and second edge detection circuits 56, 57 detect the falling edges of the output signals of the signal sensors 45L, 45R to output pulse signals in register with the rising edges, as in the above described first embodiment. The pulse signals from the first and second edge detection circuits 56, 57 are supplied to a distance calculating circuit 60 and to a left and right ear time difference detection circuit 61. The third edge detection circuit 68 detects the rising edges of the ultrasonic signal from the ultrasonic signal source 52 to output pulse signals in register with the above mentioned rising edges. The pulse signals obtained by the third edge detection circuit 58 are supplied to the distance calculating circuit 60.

The distance calculating circuit 60 detects a time difference $t_1$ between the pulse signal obtained by the third edge detection circuit 58 and the pulse signal obtained by the third edge detection circuit 56, and a time difference $t_2$ between the pulse signal obtained by the third edge detection circuit 58 and the pulse signal obtained by the first edge detection circuit 57. The calculating circuit calculates a distance $l_0$ between the ultrasonic speaker 53 and the center of the listener's head M on the basis of the time differences $t_1$ and $t_2$ and the sound velocity V.

The signals which stand for the distance $l_0$ and the time differences $t_1$, $t_2$ are transmitted to a transmission characteristics calculating circuit 62.

The left and right ear time difference detection circuit 60 detects a time difference $t_3$ between the pulse signal produced by the first edge detection circuit 56 and the pulse signal produced by the second edge detection circuit 57. A signal which stands for the time difference $t_3$ is transmitted to the transmission characteristics calculating circuit 62.

Similarly to the calculating circuit 20 of the first embodiment, the transmission characteristics calculating circuit 62 calculates, from the time differences $t_1$, $t_2$ and $t_3$, distance $l_0$, sound velocity V and the radius of the head M, in accordance with the above formula 1.

The transmission characteristics calculating circuit 62 calculates, using the time differences $t_1$, $t_2$ and $t_3$, distance sound velocity V and a radius n of the head M, an angle $\theta_0$, which stands for the orientation of the head M, similarly to the transmission characteristics calculating circuit 20 of the preceding embodiment, in accordance with the above formula 1. The calculating circuit 62 calculates, from the information concerning the angle $\theta_0$ and the distance $l_0$, indicating the relative disposition between the position of the ultrasonic speaker 53 as a reference position of an imaginary sound source and the listener's head M, a rotational angle $\theta$ of the head M relative to the desired imaginary sound source position and a relative distance l of the head M from the imaginary sound source, to find transmission characteristics in which directivity or the like of the desired imaginary sound source is taken into consideration.

The transmission characteristics information, which is obtained by the calculating circuit 62 and in which directivity or the like of the imaginary sound source is taken into consideration, is supplied to an acoustic signal processing circuit 63.

To the headphone units 42L and 42R, left and right channel acoustic signals $S_L$ and $S_R$, outputted from the acoustic signal supply source 64, are supplied from the acoustic signal processing circuit 63 by means of a pair of amplifiers 65L, 65R, respectively.

The above mentioned acoustic signal supply source 64 may be any of a variety of recorded disc reproducing apparatus, recorded tape reproducing apparatus or an electrical wave receiver, for example, adapted for outputting left and right channel acoustic signals $S_L$ and $S_R$ acoustic signals $S_L$ and $S_R$, respectively.

The acoustic signal processing circuit 63 is adapted for processing the left and right channel acoustic signals $S_L$ and $S_R$ transmitted from the acoustic signal supply source 64, and is provided with first to fourth signal processing sections **66*a*, 66*b*, 66*c* and 66*d* supplied with a transmission characteristics information which takes the directivity or the like of the imaginary sound source, obtained by the transmission characteristics calculating circuit 62**, into account. In each of these signal processing sections, an impulse response is set, which is an expression of transmission characteristics to the listener's right and left ears when the left and right channel acoustic signals $S_L$, $S_R$ are to be reproduced, on the basis of the above mentioned transmission characteristics information with the left and right channel speaker apparatus, disposed ahead of the listener at a distance from each other, as the imaginary sound source.

That is, in the first signal processing section **66*a*, an impulse response $\{h_{RR}(t, \theta)\}$ is set, which is an expression of transmission characteristics to the listener's right ear of an acoustic sound reproduced from the right channel acoustic signal $S_R$. In the second signal processing section 66*b*, an impulse response $\{h_{RL}(t, \theta)\}$ is set, which is an expression of transmission characteristics to the left ear of an acoustic sound reproduced from the right channel acoustic signal $S_R$. In the third signal processing section 66*c*, an impulse response $\{h_{LR}(t, \theta)\}$ is set, which is an expression of transmission characteristics to the right ear of an acoustic sound reproduced from the left channel acoustic signal $S_L$. Finally, in the fourth signal processing section 66*d***, an impulse response is set, which is an expression of transmission characteristics to the left ear of an acoustic sound reproduced from the left channel acoustic signals $S_L$.

In the acoustic signal processing circuit 63, the right channel acoustic signal $S_R$ is transmitted to the first and second signal processing sections **66*a*, 66*b*. In the first signal processing section 66*a*, the right channel acoustic signal $S_R$ is processed by convolutional integration of the impulse response $(h_{RR}(t, \theta)\}$. On the other hand, in the second signal processing section 66*b***, the right channel acoustic signal $S_R$ is processed by convolutional integration of the impulse response $\{h_{RL}(t, \theta)\}$.

The left channel acoustic signal $S_L$ is transmitted to the third and fourth signal processing sections **66*c*, 66*d*. In the third signal processing section 66*c*, the left channel acoustic signal $S_L$ is processed by convolutional integration of the impulse response $\{h_{LR}(t, \theta)\}$. On the other hand, in the second signal processing section 66*d***, the left channel acoustic signal $S_L$ is processed by convolutional integration of the impulse response $S_L$.

The output signal of the first signal processing section **66*a* and the third signal processing section 66*c* are summed together by a right channel adder 67R. The output of the right channel adder 67R is transmitted via right channel amplifier 65R to the right channel headphone unit 42R of the headphone device 40** so as to be reproduced as right channel acoustic signals $E_R$.

The output signals of the second signal processing section **66*b* and the fourth signal processing section 66*d* are summed together by a left channel adder 67L. The output signal of the left channel adder 67L is transmitted via left channel amplifier 67L to the left channel headphone unit 42L of the headphone device 40** so as to be reproduced as left channel acoustic signals $E_L$.

With the above described acoustic signal reproducing apparatus of the present invention, the position of a rotational angle $\theta$ of the head M relative to the desired imaginary sound source position and the relative distance l of the head from the imaginary sound source are calculated from the information concerning the above mentioned angle $\theta_0$ and the distance $l_0$ indicating the relative disposition between the listener's head M and the position of the ultrasonic speaker 53 as the reference position of the imaginary sound source to find the transmission characteristics which take the directivity or the like of the desired imaginary sound source into consideration and, on the basis of the basis of the information concerning the transmission characteristics, the left and right channel acoustic signals $S_L$ and $S_R$ are processed on the real time basis. Thus, with the present acoustic signal processing apparatus, by signal processing designed to cope with changes in transmission characteristics brought about by the listener's bodily movement and turning of the head M, a stationary eternal sound source position feeling and a stationary forward sound source feeling similar to those when the acoustic signals are reproduced by a pair of speaker devices $S_L$ and $S_R$ disposed on the front side of and in opposition to the user at a distance from each other, may be produced, as in the above described first embodiment.

The acoustic signal processing circuit 63 is responsive to the hold control signal from the control circuit 59, as long as the output signal from the level sensor 55 is logically high "H", to hold processing coefficients of the signal processing sections 66*a*, 66*b*, 66*c* and 66*d* at those values which prevailed just before the output signal of the level detection circuit 55 becomes logically high "H".

It is noted that, as long as the signal level of at least one of the output signals from the signal sensors 45L, 45R is lower than the above mentioned reference level, the edge detecting operation by the first and second edge detection circuits 56, 57 in the processing device 54 of detecting the edges of the output signals of the signal sensors 45L, 45R, is not performed in a regular manner, so that correct transmission characteristics information cannot be obtained by the transmission characteristics calculating circuit 62. Therefore, if, in the state in which the signal level of at least one of the output signals of the signal sensors 45L, 45R is lower than the above mentioned reference level, the acoustic signals $S_L$, $S_R$ for each of the channels are processed by the processing circuit 63, on the basis of the transmission characteristics information produced by the transmission characteristics calculating circuit 62, a noise will be outputted as an acoustic signal of each of the headphone units 42L, 42R.

With the acoustic signal reproducing apparatus of the present second embodiment, since the processing coefficients of the signal processing sections 66*a*, 66*b*, 66*c* and 66*d* of the acoustic signal processing circuit 63 are held, during the time when the detection output of the level detection circuit 55 is logically high "H", at those values which prevailed immediately after the detection output of the level detection circuit 55 becomes logically high "H", there is not fear that a noise be outputted as an acoustic output by the headphone units 42L and 42R.

Instead of holding the processing coefficients of the signal processing sections 66*a*, 66*b*, 66*c* and 66*d*, a control signal for muting the acoustic signals $E_L$, $E_R$ of each channel supplied to the headphone units 42L, 42R may be supplied from the control circuit 59 to the acoustic signal processing circuit 63.

Also a control signal for mixing the acoustic signals of each channel $E_L$, $E_R$, supplied to the headphone units 42L, 42R during the time when the detection output of the level detection output is logically high "H", with an alarm signal , may be supplied from the control circuit 59 to the acoustic signal processing circuit 63 to prompt the use within the range of not producing the alarm signal.

With the above described acoustic signal reproducing apparatus of the present invention, transmission characteristics with respect to an imaginary sound source are found on the basis of output signals of a pair of signal sensors sensing the position-detecting reference signals transmitted from the reference signal source, and the information which stands for the above mentioned transmission characteristics is applied to the acoustic signal processing means, in which the left and right channel acoustic signals are processed on the basis of the transmission characteristics found by the processing means, and the thus processed acoustic signals are supplied to the headphone device. In this manner, highly satisfactory binaural reproduction may be achieved in which an extremely spontaneous fixed sound image feeling may be had, in which the imaginary sound source position is not moved even when the listener should make bodily movements.

On the other hand, it is detected by level detection means that the detection level of at least one of the signal sensors has become lower than the reference level, and the acoustic signals supplied to the headphone device are controlled by control means on the basis of a detection output of the level detection means. Thus it becomes possible to prevent an undesirable noise from being outputted from the headphone apparatus when the detection level of at least one of the signal sensors becomes lower than the reference level so that the transmission characteristics as found by the processing means are not correct.

Thus the present invention provides an acoustic signal reproducing apparatus in which stable binaural reproduction may be achieved by a headphone device attached to a listener's mobile head.

What is claimed is:

1. An acoustic signal reproducing apparatus for supplying an acoustic signal to a headphone device on a listener's head, comprising:

a reference signal source for sending out a reference signal for sensing the position of the listener's head;

a pair of signal sensor means provided at two positions above the listener's head and adapted for receiving the reference signal from said reference signal source and for producing detection output signals;

processing means receiving said detection output signals for calculating a distance and a turning angle of the head relative to a reference position and for finding transmission characteristics for an imaginary sound source which is optionally positioned with said reference signal source at the reference position; and acoustic signal processing means for processing left-channel acoustic input signals and right-channel acoustic input signals on the basis of an information representing said transmission characteristics as found by said processing means;

wherein the apparatus further comprises level detection means for detecting that the detection output signal of at least one of said pair of signal sensor means has become lower than a reference level, and control means receiving processed acoustic signals from said acoustic signal processing means for controlling an acoustic signal supplied to said headphone device on the basis of a detection output of said level detection means;

wherein an alarm signal is supplied by said control means to said headphone device in response to the level detection output of said level detection means.

2. The acoustic signal reproducing apparatus according to claim 1 wherein said processing means further comprises:

distance calculating means for calculating the distance between said reference signal source and the listener's head from a phase difference between the detection output signals from said pair of signal sensor means, each receiving said reference signal; and a time difference detection means for detecting a time difference between arrival times of said reference signal at each of said pair of signal sensor means;

wherein said transmission characteristics are found based upon said distance detected by said distance calculating means and said time difference detected by said time difference detection means.

3. The acoustic signal reproducing apparatus according to claim 1 wherein said processing means further comprises a memory device in which an impulse response information associated with said transmission characteristics is stored, and wherein the impulse response information associated with said transmission characteristics is read out from said memory device on the basis of the distance detected by said distance calculating means and the time difference detected by said time difference calculating means.

4. The acoustic signal processing apparatus according to claim 3 wherein said acoustic signal processing means further comprises:

a first signal processing section for processing said right channel acoustic input signals by a convolutional integration of the impulse response associated with transmission characteristics to the right ear of right channel acoustic playback signals of input acoustic signals;

a second signal processing section for processing said right channel acoustic input signals by a convolutional integration of the impulse response associated with transmission characteristics to the left ear of the right channel playback signals of input acoustic signals;

a third signal processing section for processing said left channel acoustic input signals by a convolutional integration of the impulse response associated with transmission characteristics to the right ear of the left channel acoustic playback signals of input acoustic signals;

a fourth signal processing section for processing said left channel acoustic input signals by a convolutional integration of the impulse response associated with transmission characteristics to the left ear of left channel acoustic playback signals of input acoustic signals;

first summation means for summing an output of said first signal processing section and an output of said third signal processing section; and second summation means for summing an output of said second signal processing section and an output of said fourth signal processing section, wherein an output of said first summation means is supplied as a right channel acoustic playback signal to a right channel headphone unit of said headphone device and an output of said second summation means is supplied as a left channel acoustic playback signal to a left channel headphone unit of said headphone device.

5. The acoustic signal reproducing apparatus according to claim 1 wherein a processing coefficient of said acoustic signal processing means is held at an immediately preceding value by said control means in response to the detection output of said level detection means.

6. The acoustic signal reproducing apparatus according to claim 1 wherein acoustic playback signals supplied by said control means to said headphone device from said acoustic signal processing means are muted in response to a level detection signal from said level detection means.

7. The acoustic signal reproducing apparatus according to claim 1 wherein said reference signal source includes an ultrasonic signal source and an ultrasonic speaker for transmitting an ultrasonic signal from said ultrasonic signal source as the reference signal, and wherein said pair of signal sensor means includes a pair of ultrasonic microphones.

8. A headphone device for use by a listener, comprising:

a pair of headphone units supplied with acoustic signals from an acoustic signal source;

a main headphone body including said pair of headphone units and a connecting part interconnecting said headphone units;

at least two signal sensor means for receiving signals for detecting a head turning angle relative to a reference signal source;

supporting means for supporting said signal sensor means so that, when said main headphone body is attached to the listener's head, said signal sensor means are disposed on left and right sides of the center of said main headphone body, and so that said signal sensor means are disposed at positions spaced from said main headphone body;

said signal sensor means being attached to said main headphone body by said supporting means; and further comprising a slider slidably mounted on said connecting part, said supporting means being attached to said slider.

9. The headphone device according to claim 8 wherein said supporting means is mounted on a housing of said headphone unit.

10. The headphone device according to claim 8 wherein said supporting means are pivotally attached to said main headphone body.

11. The headphone device according to claim 8 wherein said supporting means are rotatably attached to said main headphone body.

* * * * *